United States Patent [19]

Honda

[11] Patent Number: 4,589,432

[45] Date of Patent: May 20, 1986

[54] EYELASH PERMANENT CURL SETTING ROD

[75] Inventor: Mikio Honda, Fuji-Yoshida, Japan

[73] Assignee: Royal Biken Company, Ltd., Tokyo, Japan

[21] Appl. No.: 613,321

[22] Filed: May 23, 1984

[51] Int. Cl.[4] ..... A45D 40/26

[52] U.S. Cl. ..... 132/88.7; 132/40

[58] Field of Search ..... 132/40, 42, 39, 89, 132/93, 85.1, 32 C, 31 A, 53; 156/184

[56] References Cited

U.S. PATENT DOCUMENTS

| | | | |
|---|---|---|---|
| 1,532,238 | 4/1925 | Farrell | 132/31 A |
| 1,795,482 | 3/1931 | Ehmann | 132/32 C |
| 2,079,256 | 5/1937 | Kaiser | 132/53 |
| 2,138,568 | 11/1938 | Brandenberger | 156/184 |
| 2,925,021 | 2/1960 | Basta | 132/39 |
| 2,972,994 | 2/1961 | Ferens | 132/40 |
| 3,247,857 | 4/1966 | Kanbak | 132/93 |
| 3,556,114 | 1/1971 | Simon | 132/40 |
| 3,888,266 | 6/1975 | Weldon | 132/39 |
| 3,935,872 | 2/1976 | Aylott | 132/31 A |
| 4,022,226 | 5/1977 | Muenstermann | 132/40 |
| 4,304,245 | 12/1981 | Lichfield | 132/89 |

*Primary Examiner*—Gregory E. McNeill

*Attorney, Agent, or Firm*—Schwartz & Weinrieb

[57] ABSTRACT

An eyelash permanent curl setting rod comprises a rod member of a small diameter and a coating of adhesive agent applied to the circumferential periphery of the rod member. This eyelash permanent curl setting rod easily imparts attractive permanent curls to the eyelashes by causing the eyelashes to be wound on the rod and kept so curled up for a stated length of time as moistened in the meantime with cold permanent wave lotion, and thereafter released from the rod.

20 Claims, 6 Drawing Figures

EYELASH PERMANENT CURL SETTING ROD

BACKGROUND OF THE INVENTION

1. Field of the Invention

This invention relates to an eyelash permanent curl setting rod to be used for cold setting permanent curls in eyelashes.

2. Description of the Prior Art

Light outward curls imparted to the eyelashes add an attractive accent to the cast of the eyes. As a device for producing such curls in the eyelashes, an eyelash curler has been proposed which, on being manipulated like a pair of scissors, nips the eyelashes in a curved form and consequently curls them. When this curler is not so effective in setting lasting curls in the eyelashes as expected, the user may elect to give the eyelashes already curled with this curler an additional treatment with a cold permanent wave lotion of the kind used on the hair of the head. The curler of the construction described above is not capable of producing smooth curls. With this curler, it is difficult to make proper adjustment of the intensity of force with which the eyelashes are nipped or the degree of angle with which the curler is held relative to the eyelashes. Further the curler is difficult to manipulate. When the hair to be curled is long like the hair on the head, permanent wave may be easily set thereon by causing the hair to be wound on a cylindrical curler and kept down thereon with a rubber band or clip stretched thereon and fastened to the opposite ends of the cylindrical curler. Since the eyelashes are short, however, they cannot be wound and held in that state like the hair on the head.

If a small curler rod similar in construction to the aforementioned curler rod intended for the hair on the head is used for producing permanent curls in the eyelashes, it is required to be extremely light and small, to possess a moderate degree of adhesiveness and to be readily removed from the eyelashes after completion of the curling treatment. None of the eyelash permanent curl setting rods heretofore proposed satisfies all these requirements.

OBJECT OF THE INVENTION

An object of this invention is to provide an eyelash permanent curl setting rod which is capable of assuming a shape befitting the kind of eyelashes under treatment and the purpose of treatment, light in small, and easy to manipulate, exhibits adhesiveness, enjoys ready removability, and produces permanent curls advantageously in the eyelashes as desired.

SUMMARY OF THE INVENTION

To accomplish the object described above, the eyelash permanent curl setting rod of this invention comprises a rod member of a small diameter and an adhesive layer formed on the periphery of the rod member.

The rod member may be hollow or solid and is made of a light material. The adhesive agent which is used to form the adhesive layer on the rod member is required to possess moderate adhesiveness to be easily removable from the eyelashes after use.

BRIEF DESCRIPTION OF THE DRAWINGS

The other objects and characteristics of this invention will become apparent from the further disclosure to be made in the following description of preferred embodiments with reference to the accompanying drawings wherein.

DESCRIPTION OF THE PREFERRED EMBODIMENTS

Figure 2:
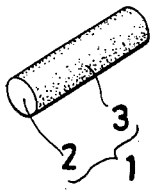
FIG. 2 is a perspective view illustrating another embodiment of the rod of the present invention.
Figure 3:
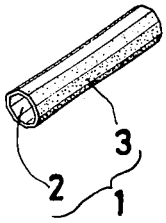
FIG. 3 is a perspective view illustrating yet another embodiment of the rod of this invention.

In the drawings, 1 denotes an eyelash permanent curl setting rod according to this invention. This curl setting rod 1 is substantially composed of a rod member 2 of a small diameter and an adhesive layer 3 which is applied to the circumferential periphery of the rod member 2. The rod member 2 is a hollow cylinder of 1 to 5 mm in outside diameter and about 5 to 20 mm in length. Of course, the rod member may be a solid cylinder as illustrated in FIG. 2. As illustrated in FIG. 3, it may be a hollow or solid polygonal prism.

Figure 1:
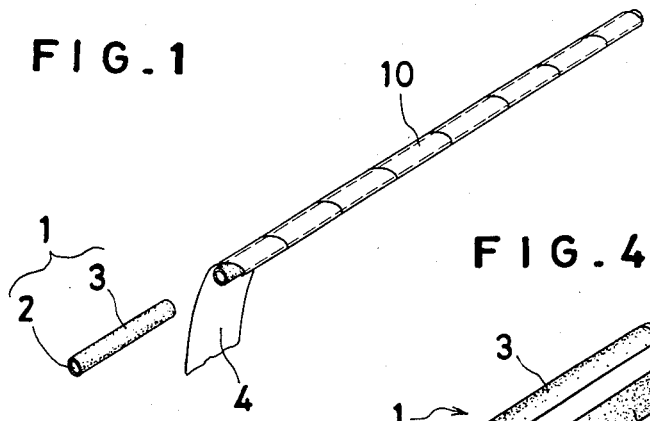
FIG. 1 is a perspective view illustrating one preferred embodiment of the rod of the present invention.
Figure 4:
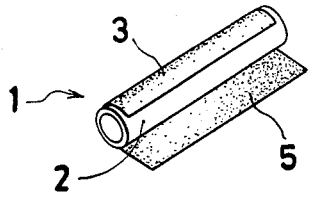
FIG. 4 is a perspective view illustrating a further embodiment of the rod of this invention.

The material of the rod member is desired to be light. It may be made of plastic, rubber or wood, for example, bamboo. Otherwise, it may be in the form of a roll of a sheet of cellophane or paper. As the adhesive layer 3, an adhesive agent may be used. In this case, the application of the adhesive agent may be effected by the use of a brush or a spray. Otherwise, it may be effected by immersing the rod member in a bath of the adhesive agent and doping it with the adhesive agent, or a double-sided adhesive tape 5 may be wound around the rod member 2 of an elastic material as illustrated in FIG. 4.

Figure 5:
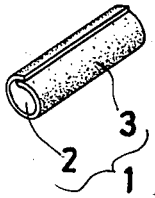
FIG. 5 is a perspective view illustrating still another embodiment of the rod of this invention.

To make the rod with a rolled sheet of cellophane, for example, mucilage is spread on one surface of a sheet of cellophane and this sheet is rolled in a desired small diameter, with the coated surface thereof falling on the outside, and the opposed edges of this sheet of cellophane are superposed as illustrated in FIG. 5 and joined in the superposed state through the medium of the mucilage to complete the rod member 2. In this case, the layer of the mucilage on the outer surface of the rolled sheet of cellophane serves as the adhesive layer 3. The mucilage thus used on the rod member may be any of the known adhesive agents which are not harmful to the skin or the hair, such as debilitated gum arabic, which dries slowly and maintains its viscosity for hours.

The rod member 2 is cut to a suitable length of 5 to 20 mm. To prevent the adhesive layer 3 on the periphery of the rod member 2 from gathering dirt and losing adhesive strength, each rod or a group of several rods arranged neatly end to end is wrapped in paper 4. The rod may be removed from this package prior to use. Optionally, a continuous mother rod 10 of a length of say 10 cm which is equivalent to a series of several rods put together end to end may be wholly wrapped in paper 4. It is readied for use by tearing off the paper enough to expose a length, about 5 to 20 mm, of the mother rod desired to be cut off and cutting off the exposed length of the mother rod. Alternatively, this continuous rod in the paper may be readied for use by cutting a desired length of the mother rod as wrapped in the paper and subsequently removing the paper remaining on the cut piece of the rod.

Use of this rod is accomplished by causing the rod to adhere to the leading ends of eyelashes through the medium of the adhesive layer, applying the cold permanent wave lotion to the eyelashes in much the same way as it is used on the hair of the head, and allowing the rod to adhere to the eyelid again through the medium of the adhesive layer 3. As compared with the hair of the head, the eyelashes grow sparsely and to a small length. Thus, the individual eyelashes are wound on the rod one turn at most. Between the adjacent eyelashes thus wound on the rod, the adhesive layer is exposed. The exposed portion of the adhesive layer is enough to keep the curled eyelashes fast to the skin of the eyelid.

Figure 6:
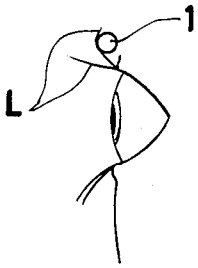
FIG. 6 is an explanatory view illustrating the condition in which the rod of this invention is put to use.

Otherwise, fastening of the eyelashes to the rod may be accomplished by winding the eyelash L round the rod 1 one by one after bringing the rod 1 into contact with the skin of the eyelid to retain it in position as illustrated in FIG. 6. In this case, cream having moderate adhesiveness may be applied to the skin of the eyelid in advance.

After the eyelashes are curled up and fastened to the skin as described above, the user applies the cold permanent wave lotion to the curled eyelashes while taking care not to allow the lotion to enter the eyes. After the elapse of a required length of time, the rod 1 is removed from the skin of the eyelid and then turned in the opposite direction to release the eyelashes from adhesion.

Since the eyelashes grow along the arcuately curved edges of the eyelid, use of just one rod 1 is not enough to curl all the eyelashes growing along the upper and lower lids of each eye. Two or three rods are used for each eye. This explains why the length of the rod is limited to 0.5 to 20 mm. Thus, the eyelash permanent curl can be given in about an hour.

In accordance with this invention, permanent curls are imparted to the eyelashes to enhance the effect of beautification notably.

Obviously, many modifications and variations are possible in light of the above teachings. It is therefore to be understood that within the scope of the appended claims, the present invention may be practiced otherwise than as specifically described herein.

What is claimed is:

1. An eyelash permanent curl setting rod, in connection with which permanent hair setting solution is to be used, comprising:

a single rod member having a diametrical extent sufficiently small so as to permit human eyelashes to be wrapped about said single rod member in a circumferential manner; and adhesive means disposed upon the outer periphery of said single rod member for permitting said eyelashes to adhere to said single rod member and for permitting said single rod member to adhere to the human eyelid when said eyelashes are circumferentially wrapped about said single rod member so as to curl said eyelashes in conjunction with said permanent hair setting solution.

2. An eyelash permanent curl setting rod according to claim 1, wherein said rod member is hollow.

3. An eyelash permanent curl setting rod according to claim 1, wherein said rod member is solid.

4. An eyelash permanent curl setting rod according to claim 1, wherein said rod member is formed by rolling a sheet of material.

5. An eyelash permanent curl setting rod according to claim 1, wherein the adhesive agent applied to the circumferential periphery is mucilage.

6. An eyelash permanent curl setting rod according to claim 1, wherein the rod has an outer diameter of 1 to 5 mm and a length of 5 to 20 mm.

7. An eyelash permanent curl setting rod according to claim 1, wherein said rod member is hollow and elastic, and a double-sided adhesive tape is wound around the rod member.

8. An eyelash permanent curl setting rod as set forth in claim 1, wherein:

said rod member has a cylindrical configuration.

9. An eyelash permanent curl setting rod as set forth in claim 8, wherein:

said rod member has a polygonal configuration as viewed in radial cross-section.

10. An eyelash permanent curl setting rod as set forth in claim 4, wherein:

said sheet of material comprises cellophane.

11. An eyelash permanent curl setting rod as set forth in claim 4, wherein:

said sheet of material comprises paper.

12. An eyelash permanent curl setting rod as set forth in claim 5, wherein:

said mucilage is debilitated gum arabic.

13. An eyelash permanent curl setting rod, in connection with which permanent hair setting solution is to be used, comprising:

a single rod member having a diametrical extent sufficiently small so as to permit human eyelashes to be wrapped about the outer peripheral surface of said single rod member in a circumferential manner; and adhesive means disposed upon said outer peripheral surface of said single rod member for permitting said eyelashes to adhere to said single rod member and for permitting said single rod member to adhere to the human eyelid when said eyelashes are circumferentially wrapped about said single rod member so as to curl said eyelashes under the influence of said permanent hair setting solution.

14. An eyelash permanent curl setting rod as previously set forth in claim 13, wherein:

said single rod member is hollow.

15. An eyelash permanent curl setting rod as set forth in claim 13, wherein:

said single rod member is solid.

16. An eyelash permanent curl setting rod as set forth in claim 13, wherein:

said adhesive means comprises mucilage.

17. An eyelash permanent curl setting rod as set forth in claim 16, wherein:

said mucilage is debilitated gum arabic.

18. An eyelash permanent curl setting rod as set forth in claim 13, wherein:

said rod has an outer diameter within the range of 1–5 mm and a length within the range of 5–20 mm.

19. An eyelash permanent curl setting rod as set forth in claim 13, wherein:

said adhesive means comprises double-sided adhesive tape wound about said outer peripheral surface of said single rod member.

20. An eyelash permanent curl setting rod as set forth in claim 13, wherein:

said single rod member has a cylindrical configuration.

* * * * *